United States Patent [19]

Nossiter

[11] 4,037,558

[45] * July 26, 1977

[54] MARINE DRIVE UNITS

[75] Inventor: Clarence Frank Nossiter, Shorwell, England

[73] Assignee: Enfield Industrial Engines Limited, Cowes, England

[ * ] Notice: The portion of the term of this patent subsequent to July 30, 1991, has been disclaimed.

[21] Appl. No.: 454,961

[22] Filed: Mar. 26, 1974

Related U.S. Application Data

[62] Division of Ser. No. 270,512, July 10, 1972, Pat. No. 3,826,219.

[30] Foreign Application Priority Data

| | | |
|---|---|---|
| July 9, 1971 | United Kingdom | 32311/71 |
| Nov. 6, 1971 | United Kingdom | 51646/71 |

[51] Int. Cl.[2] ..... B63H 5/12

[52] U.S. Cl. ..... 115/41 HT; 115/34 R

[58] Field of Search ..... 115/34 R, 35, 41 R, 115/41 HT, 17, 18 R

[56] References Cited

U.S. PATENT DOCUMENTS

| | | | |
|---|---|---|---|
| 2,507,844 | 5/1950 | Wright | 115/41 R |
| 3,166,040 | 1/1965 | Armantrout et al. | 115/41 R ; |
| 3,826,219 | 7/1974 | Nossiter | 115/34 R |
| 3,847,108 | 11/1974 | Shimanckas | 115/35 |

*Primary Examiner*—Trygve M. Blix
*Assistant Examiner*—Charles E. Frankfort
*Attorney, Agent, or Firm*—Marshall & Yeasting

[57] ABSTRACT

The invention provides a marine drive unit of the through or over transom drive type, in which the power leg is pivoted on the axis of a transverse shaft at the heart of the drive transmission so that the power leg can tilt upwardly and rearwardly about that axis whilst the drive gears remain meshed, without utilising any universal joints.

1 Claim, 3 Drawing Figures

MARINE DRIVE UNITS

CROSS-REFERENCE TO RELATED APPLICATION

This is a division of application Ser. No. 270,512, filed July 10, 1972, now U.S. Pat. No. 3,826,219.

BACKGROUND OF THE INVENTION

This invention relates to marine vessel drive units of the known kind in which an inboard engine is coupled to the propeller by an engine shaft extending to and through (or over) the vessel transom, and having a power leg which extends generally vertically downwards to transmit drive to the propeller which is usually carried on a shaft parallel to the engine shaft, although it will be appreciated that the engine shaft could be horizontal or inclined and the propeller axis determined by the trim of the vessel and other considerations.

There is a requirement or desirability for several distinct movements of the propeller shaft, namely the capability for upward pivoting so that in the event of the power leg hitting an underwater obstacle it can kick up to minimise risk of damage to the power leg, and for like movements to smaller degree to trim the propeller to the most favourable angle for drive.

For beaching of vessels it is also desirable to have such capability, although it is sometimes preferred to swing the power leg laterally instead of rearwardly and upwardly, and like movement capability is also useful for inspection, maintenance and the like.

For steering purposes it is usually preferred to turn the propeller shaft about the power leg axis or like, thus avoiding the need for a separate rudder.

In order to provide some or all of these movements many different designs have been proposed, but in order to maintain the drive transmission (and also steering connections) it has often been necessary to provide several universal joints in the drive shafts and also provide complex sets of gimbals, swivels and the like.

SUMMARY OF THE INVENTION

The objects of the invention are to provide simple designs which achieve or enable some or all of these movements to be accomplished, thus providing, desirably, compact and efficient units which are cheaper to manufacture and more reliable in service.

In accordance with one aspect of the invention, a marine drive unit comprises a power leg having a propellar driven via a transmission from a shaft extending transversely of the length of said leg, said leg being adapted to pivot about the axis of said shaft.

Also in accordance with the invention a marine drive unit comprises a head for mounting on the transom of a boat, a power leg depending from the head and carrying a propeller, and a drive transmission including a first shaft for extending through or over the transom, a second shaft extending up the power leg and a third shaft extending to the propeller, the first and third shafts being generally usually approximately parallel and the second shaft being generally and usually perpendicular to the other two, in which an intermediate shaft is located in the drive between the first and second shafts and the power leg is arranged to pivot about said intermediate shaft.

DESCRIPTION OF THE PREFERRED EMBODIMENTS

Figure 1:
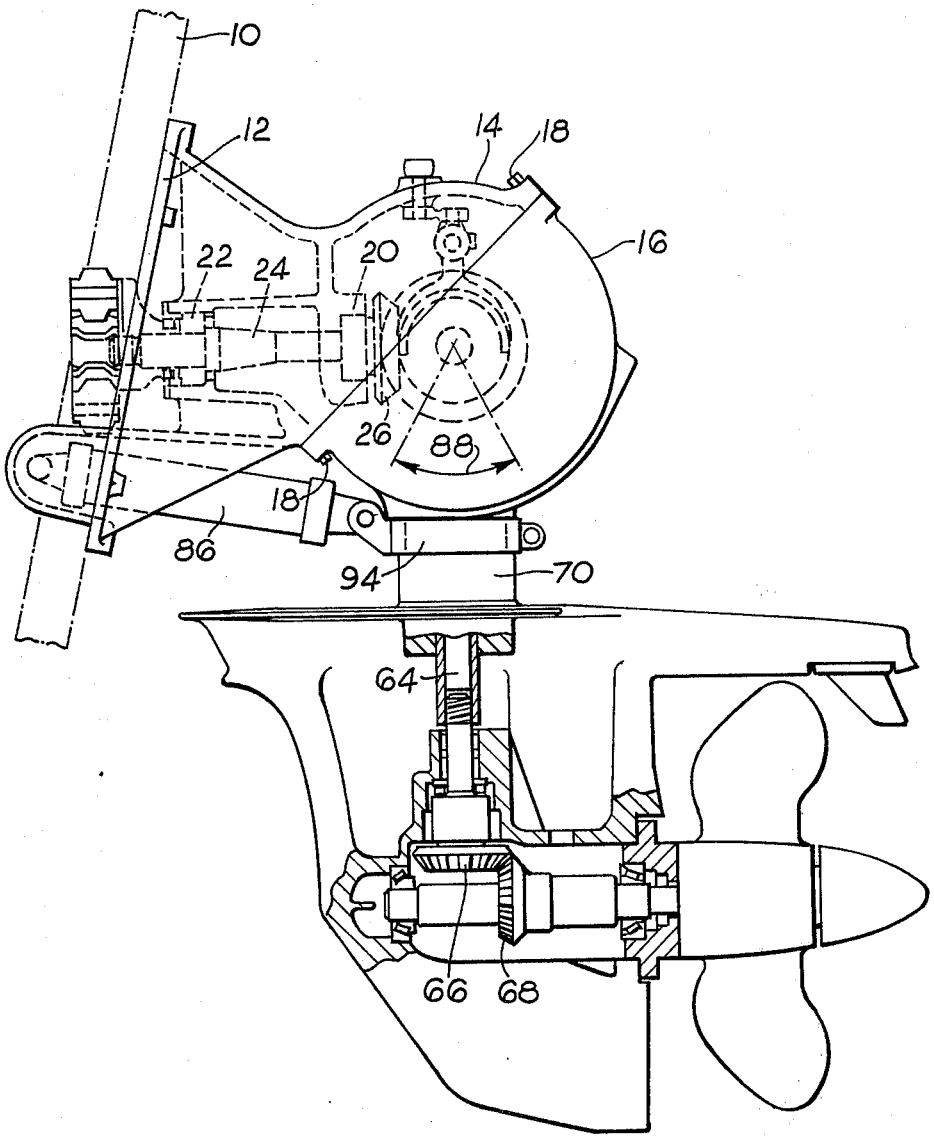
FIG. 1 is an elevation, partly in section, of a first and presently preferred embodiment showing a portion of a boat to which it is attached.
Figure 2:
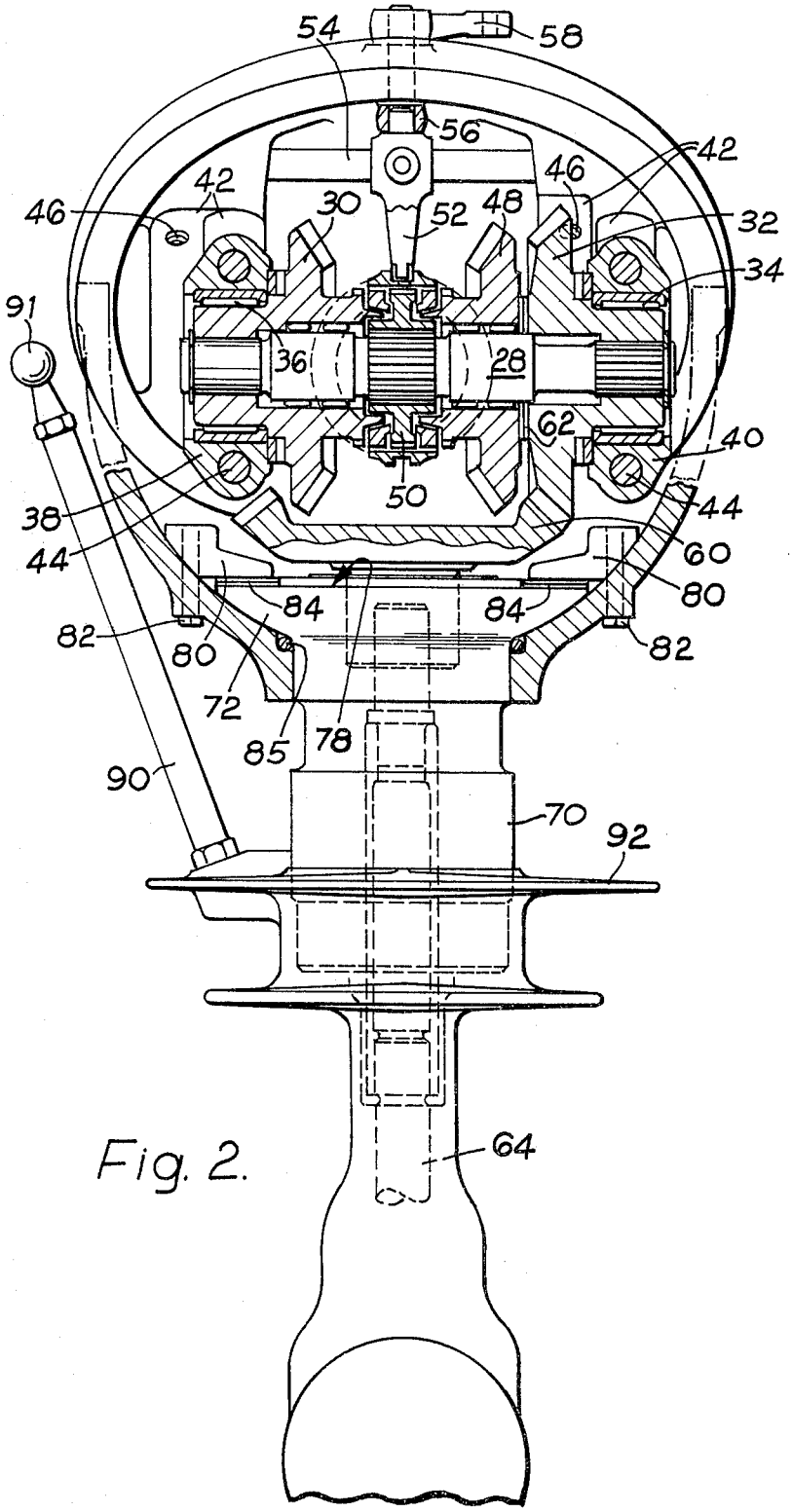
FIG. 2 is an enlarged cross-sectional view of the same.
Figure 3:
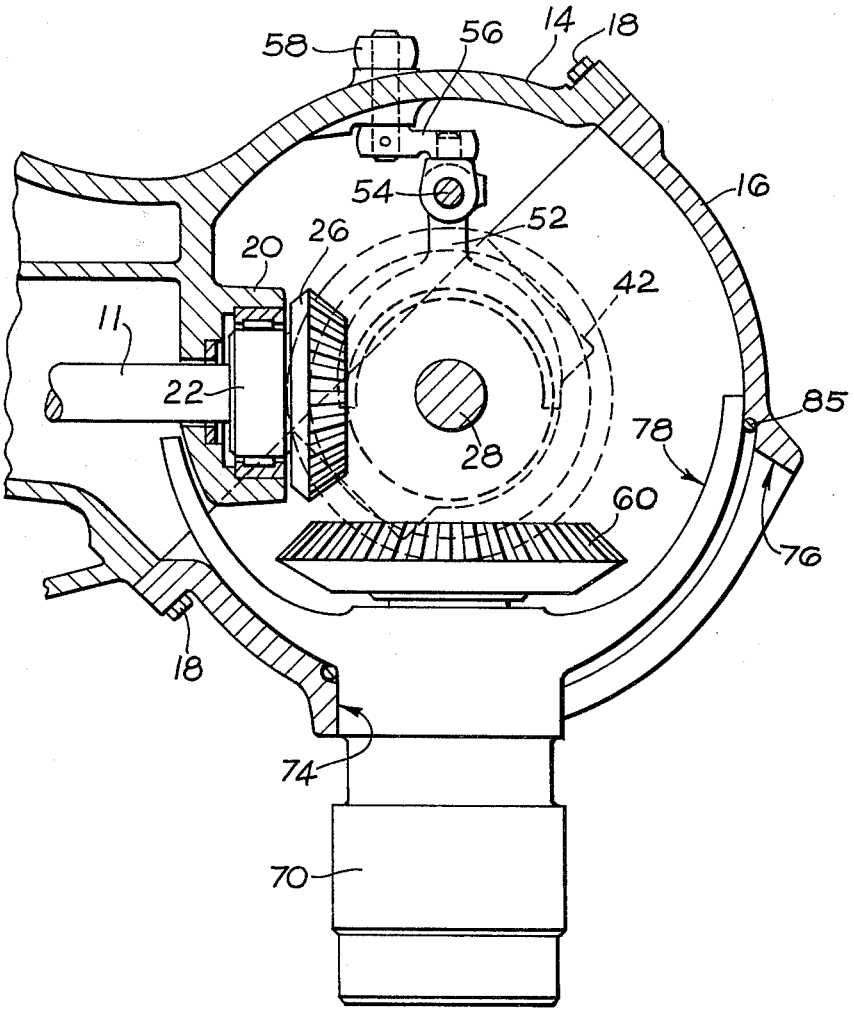
FIG. 3 is an enlarged view similar to a portion of FIG. 1, in section.

Referring now to the drawings and especially FIGS. 1–3 thereof, the drive unit is attached to the transom 10 by a mounting plate 12 on the exterior of the same. The unit comprises a generally spherical head unit made conveniently as castings and split on a plane parallel to a diameter, the parts 14, 16 being bolted together at 18. Part 14 which incorporates the mounting plate or is connected thereto journals at 20, 22 a first drive shaft 24, which terminates in the vicinity of the through-transom aperture, in a drive coupling for connection to an engine shaft (not shown) and this shaft is conveniently on the fore and aft centre line of the boat (if a single unit is employed). At the other end a first bevel gear 26 is provided. These parts are best seen in FIG. 1.

Extending transversely of the axis of shaft 24, and on the diameter of the spheroidal casing or head is a second or intermediate shaft 28, FIG. 2, which is splined at one end to be fast with a drive bevel 32. At its opposite end, the shaft 28 rotatably supports the drive bevel 30 the drive bevels 30, 32 are journalled, e.g. by needle rollers 34, 36, into trunnion blocks 38, 40 which are bolted to the casing or head against bosses 42 provided for this purpose. Two pairs of boss flats and bolt holes are provided so that the assembly of parts 28-40 — which is asymmetric — may be turned through 180° and reassembled, using different pairs of holes, the bolts being indicated by reference 44 and the holes unused in the illustrated position by references 46: the purpose of this will be explained hereinafter. A third drive bevel 48 is also mounted on the shaft 28 and between bevels 48 and 30 is a drive dog assembly 50 which is slidably splined to the shaft and is arranged to dog-engage either bevel 30 or bevel 48 or be in a neutral condition therebetween.

Selector fork 52 engages the dog assembly 50, is slidable (to remain in one of a series of parallel planes) on cross spindle 54 and to be displaced by crank 56 from an external clutch/gear selector 58.

Also mounted in the head or casing is final drive bevel 60 which is permanently meshed with bevel 32 and is rotatable on a third axis or vertical axis intersecting the axes of shafts 28, 24 at the centre of the head.

These parts are best seen in FIG. 2.

It will be seen that in one gear selector position, drive is transmitted from shaft 24, via bevels 26 and 30 to shaft 28 and hence to bevel 32 and final drive bevel 60. In the opposite selected position, drive is via shaft 24, bevel 26, bevel 48, shaft 28 and to the bevels 32 and 60, i.e. in the opposite sense. In the latter event, bevels 48, 32 rotate in the same sense, but in the former case, bevel 48 in the opposite sense to bevel 32. For this reason shim bearings or anti-friction races 62 are provided between bevels 48 and 32, and it is preferred to provide that forward gear shall be via bevel 48 and reverse gear via bevel 30. This depends upon the direction of rotation of shaft 24 and the hand of the propeller, but the reversibility of the unit 28–40 as explained above, enables the preferred arrangement of drive to be obtained in a simple manner. This is also useful in a twin-screw vessel when the unit is in duplication, one on each side of the fore or aft longitudinal axis of the vessel, in enabling two propellers to be used of opposite head.

Final drive bevel 60 is fast with shaft 64 which extends down the power leg to drive the propeller via output bevels 66, 68. Shaft 64 is journalled in the power leg casing 70 which includes a flange 72 having a part spherical surface seating inside the head and extending through a slot therein. The slot has parallel sides and semi-circular ends and extends at least from the position vertically below the centre of the head around the head, that is rearwardly and upwardly, being symmetrical of a vertical plane containing the axis of shaft 24. The ends of the slot are indicated by references 74, 76, FIG. 3.

Flange 72 has a part-spherical concave upper surface 78 (FIGS. 2 and 3) lying normally of the shaft 64 axis, and is trapped between slipper blocks 80 and the head interior and the blocks are bolted in place at 82 and bearing shims 84 which might be Belleville sping washers are located between the slippers and the said surface 78 (FIG. 2). The flange is thus held against the head but permitted to turn about the centre to take the power leg along the slot. A seal ring 85 is located at the periphery of the slot and may be of elastomeric material.

The angle of inclination of the power leg to the transom is controlled, e.g. by a ram 86, FIG. 1 coupled between the leg and the transom and associated with valve means holding fluid pressure in the ram to control its effective length, and in the event of the leg hitting an underwater obstacle this may apply a load sufficient to overcome the valve and allow the ram to extend and the leg to pivot along the slot. Alternatively spring loaded catches may be employed to the same end.

The angle of the leg is important for achieving most efficient propeller action and depends upon the trim of the boat, and variation of the ram length may achieve best results. The length of the slot controls the adjustment which is possible but this can easily be over 60° arc, as indicated for example by the chain dot lines 88, FIG. 1.

Steering is achieved by turning the power leg about the shaft 64 axis, e.g. via steering link 90 fixed to flange 92 of the casing 70, and the leg may then turn in the coupling 94 at which the ram is connected.

By locating the ball end 91 of the link 90 on the axis of shaft 28 (FIG. 2) the steering connection is not distrubed when the leg kicks up or is adjusted up (or down) on ram extension (or contraction).

If desired the whole unit can be swivelled sideways out of the water for inspection or maintenance by providing the mounting flange 12 with a rotatable connection on the transom.

Lubrication may be provided in known fashion and oil seals may be provided to contain lubricant within specific areas of the units.

I claim;

1. In a marine drive unit for transmitting drive between an inboard engine of a vessel and a propeller thereof, which comprises:- a first casing adapted to be mounted on the transom of the vessel and rotatably mounting a horizontal lay shaft which extends transversely of the fore-and-aft axis of the vessel;

an input shaft adapted to be drivingly connected to the inboard engine and extending in the fore-and-aft direction;

a pair of first drive transmitting elements mounted rotatably, and in spaced relation, on said lay shaft and in constant mesh with a driving element carried by the input shaft so as to contra-rotate with respect to one another;

a second drive transmitting element fast with said lay shaft;

a power leg shaft extending orthogonally with respect to said input shaft and said lay shaft and having a drive element in constant mesh with said second drive transmitting element;

a second casing through which the power leg shaft extends, the second casing being pivotal with respect to said first casing about said lay shaft and rotatable about the axis of the power leg shaft;

a propeller drive shaft mounted in the second casing and drivingly connected to the power leg shaft;

clutch means selectively operable to drivingly connect one or the other of said first drive transmitting elements to the lay shaft to transmit rotational drive from the input shaft to the propeller shaft in a desired rotational sense, the improvement wherein;

the second casing extends through a slot in the first casing;

said slot extends arcuately about the axis of said lay shaft;

the second casing is formed with an extension having a part-spherical flange which is received within the first casing and is co-operable with a complementary spherical inner surface of the first casing; and the center of curvature of said complementary inner surface being coincident with the point of intersection between the lay shaft and the power leg shaft whereby the second casing may pivot about the axis of the lay shaft and rotate about the axis of the power leg shaft.

* * * * *